United States Patent [19]

Bisey

[11] Patent Number: 4,545,280

[45] Date of Patent: Oct. 8, 1985

[54] MUSICAL KEYBOARD INSTRUMENT SUPPORT DEVICE

[76] Inventor: Robert P. Bisey, 2339 Spruce St., Seaford, N.Y. 11783

[21] Appl. No.: 574,478

[22] Filed: Jan. 27, 1984

[51] Int. Cl.[4] ..... G10C 3/02

[52] U.S. Cl. ..... 84/177; 84/431; 84/DIG. 17; 248/664; 248/680

[58] Field of Search ..... 84/177, 430, 431, DIG. 17; 248/640, 660, 664, 680

[56] References Cited

FOREIGN PATENT DOCUMENTS 3481 of 1887 United Kingdom ..... 84/431

*Primary Examiner*—Lawrence R. Franklin

*Attorney, Agent, or Firm*—Daniel Jay Tick

[57] ABSTRACT

A support device for supporting first and second units has an instrument platform having first and second spaced opposite parallel planar surfaces. The instrument platform is rotatably supported for rotation about an axis of rotation. A first joining subassembly pivotally mounts the first unit on the first surface of the instrument platform for rotation about an axis spaced from and parallel to the axis of rotation. A first pair of locking devices lock the first unit in abutting relation to the first surface in locked position and release the first unit to hang freely at various angles with the first surface in unlocked position whereby the first unit is in playing position when the instrument platform is horizontal with the first surface up and in stored position, hanging from the first surface, when the instrument platform is horizontal with the first surface down. A second joining subassembly pivotally mounts the second unit on the second surface of the instrument platform for rotation about an axis spaced from and parallel to the axis of rotation. A second pair of locking devices lock the second unit in abutting relation to the second surface in locked position and release the second unit to hang freely vertically with the second surface in unlocked position whereby the second unit is in playing position when the instrument platform is horizontal with the second surface up and in stored position, hanging from the second surface, when the instrument platform is horizontal with the second surface down.

13 Claims, 23 Drawing Figures

MUSICAL KEYBOARD INSTRUMENT SUPPORT DEVICE

BACKGROUND OF THE INVENTION

The present invention relates to a musical keyboard instrument support device. More particularly, the invention relates to a device for commonly supporting two musical keyboard instruments in a manner whereby a selected one of such instruments is in a playing position while the other is in a storage position. During use of the one of the instruments in the playing position, the instrument in the storage position is maintained at the rear of the support device of the invention in order to provide adequate sitting knee and leg room for the musician at the instrument being played.

There are many musical keyboard instruments in use, including portable units such as, for example, electronic pianos, organs, synthesizers, and so on. Each of these instruments has a keyboard via which it is played. If a musician wishes to play two of these instruments in the same time period, he or she must have both instruments available.

The principal object of the invention is to provide a device for commonly supporting more than one musical keyboard instrument.

An object of the invention is to provide a device for commonly supporting two musical keyboard instruments.

Another object of the invention is to provide a device for commonly supporting two musical keyboard instruments in a manner whereby a selected one of the instruments is maintained in a playing position while the other of the instruments is in a storage position.

Still another object of the invention is to provide a device which is of simple structure and light in weight for commonly supporting two musical keyboard instruments such as electronic pianos, organs, or the like.

Yet another object of the invention is to provide a device of simple structure which is usable with facility, rapidity, and ease by anyone, however unskilled, to commonly support two musical keyboard instruments.

Another object of the invention is to provide a device for commonly supporting two musical keyboard instruments in a manner whereby one of the instruments is in substantially horizontal playing position while the other of the instruments is in stored position, hanging out of the way of the one instrument and the musician.

BRIEF SUMMARY OF THE INVENTION

In accordance with the invention, a support device for supporting first and second units, each having a front edge and a pair of spaced opposite substantially parallel sides at the opposite ends of the front edge substantially perpendicular to the front edge, comprises an instrument platform having first and second spaced opposite substantially parallel substantially planar surfaces. Mounting means rotatably supports the instrument platform for rotation about an axis of rotation. First joining means pivotally mounts the first unit on the first surface of the instrument platform for rotation about an axis spaced from and substantially parallel to the axis of rotation. A first pair of locking means lock the first unit in substantially abutting relation to the first surface in locked position and release the first unit to hang freely substantially vertically with the first surface in unlocked position whereby the first unit is in playing position when the instrument platform is substantially horizontal with the first surface up and in stored position, hanging from the first surface, when the instrument platform is substantially horizontal with the first surface down. Second joining means pivotally mounts the second unit on the second surface of the instrument platform for rotation about an axis spaced from and substantially parallel to the axis of rotation. A second pair of locking means lock the second unit in substantially abutting relation to the second surface in locked position and release the second unit to hang freely substantially vertically with the second surface in unlocked position whereby the second unit is in playing position when the instrument platform is substantially horizontal with the second surface up and in stored position, hanging from the second surface, when the instrument platform is substantially horizontal with the second surface down.

Each of the first and second units is an instrument, a keyboard instrument having a keyboard extending along the front edge thereof, a musical keyboard instrument having a keyboard extending along the front edge thereof, an electronic musical keyboard instrument, or the like.

The first joining means comprises a first pair of plate mounting brackets affixed to the first surface of the instrument platform in spaced substantially parallel relation, substantially perpendicular to the first and second surfaces and to the axis of rotation. The second joining means comprises a second pair of plate mounting brackets affixed to the second surface of the instrument platform in spaced substantially parallel relation, substantially perpendicular to the first and second surfaces and to the axis of rotation.

The first joining means further comprises a first pair of support plates each clamped to a corresponding side of the first unit. Each of the first pair of support plates is pivotally coupled to a corresponding one of the first pair of plate mounting brackets. The second joining means further comprises a second pair of support plates each clamped to a corresponding side of the second unit. Each of the second pair of support plates is pivotally coupled to a corresponding one of the second pair of plate mounting brackets.

The first joining means further comprises a first pair of locking means each pivotally mounted on a corresponding one of the first pair of support plates and interposed between and cooperating with the corresponding one of the support plates and the corresponding one of the first pair of plate mounting brackets for locking the first unit in substantially abutting relation to the first surface in locked position and for releasing the first unit to hang freely from the first pair of plate mounting brackets substantially vertically with the first surface in unlocked position. The second joining means further comprises a second pair of locking means each pivotally mounted on a corresponding one of the second pair of support plates and interposed between and cooperating with the corresponding one of the support plates and the corresponding one of the second pair of plate mounting brackets for locking the second unit in substantially abutting relation to the second surface in locked position and for releasing the second unit to hang freely from the second pair of plate mounting brackets substantially vertically with the second surface in unlocked position.

In accordance with the invention, a musical keyboard instrument device for supporting first and second musical keyboard instruments each having a front edge, a keyboard extending along the front edge and a pair of spaced opposite substantially parallel sides at the opposite ends of the front edge, substantially perpendicular to the front edge, comprises an instrument platform having first and second spaced opposite substantially parallel substantially planar surfaces. Mounting means rotatably supports the instrument platform for rotation about an axis of rotation. A first pair of plate mounting brackets are affixed to the first surface of the instrument platform in spaced substantially parallel relation, substantially perpendicular to the first and second surfaces and to the axis of rotation. Each of a first pair of instrument support plates is clamped to a corresponding side of the first keyboard instrument. Each of the first pair of instrument support plates is pivotally coupled to a corresponding one of the first pair of plate mounting brackets. Each of a first pair of locking means is pivotally mounted on a corresponding one of the first pair of instrument support plates and interposed between and cooperating with the corresponding one of the first pair of instrument support plates and the corresponding one of the first pair of plate mounting brackets for locking the first keyboard instrument in substantially abutting relation to the first surface in locked position and for releasing the first keyboard instrument to hang freely from the first pair of plate mounting brackets substantially vertically with the first surface in unlocked position whereby the first keyboard instrument is in playing position when the instrument platform is substantially horizontal with the first surface up and in stored position, hanging from the first pair of plate mounting brackets, when the instrument platform is substantially horizontal with the first surface down. A second pair of plate mounting brackets are affixed to the second surface of the instrument platform in spaced substantially parallel relation, substantially perpendicular to the first and second surfaces and to the axis of rotation. Each of a second pair of instrument support plates is clamped to a corresponding side of the second keyboard instrument. Each of the second pair of instrument support plates is pivotally coupled to a corresponding one of the second pair of plate mounting brackets. Each of a second pair of locking means is pivotally mounted on a corresponding one of the second pair of instrument support plates and interposed between and cooperating with the corresponding one of the second pair of instrument support plates and the corresponding one of the second pair of plate mounting brackets for locking the second keyboard instrument in substantially abutting relation to the second surface in locked position and for releasing the second keyboard instrument to hang freely from the second pair of plate mounting brackets substantially vertically with the second surface in unlocked position whereby the second keyboard instrument is in playing position when the instrument platform is substantially horizontal with the second surface up and in stored position, hanging from the second pair of plate mounting brackets, when the instrument platform is substantially horizontal with the second surface down.

A plurality of instrument retention clamps adjustably couple each of the first and second pair of instrument support plates to the corresponding first and second keyboard instruments.

First means selectively maintains the instrument platform in substantially horizontal position and preventing rotation thereof in a predetermined direction. Second means permits the instrument platform to rotate in a determined direction and prevents the instrument platform from rotating in the opposite direction.

Each of the first and second pair of locking means comprises a substantially L-shaped member having a corner, two arms extending from the corner substantially perpendicularly to each other and substantially coplanar, a locking stud affixed to one of the arms and means pivotally affixing each of the L-shaped members at its corner to a corresponding one of the instrument support plates. Each of the first and second pair of plate mounting brackets has a locking slot formed therein and a cam surface formed thereon to facilitate locking operation of the locking stud of each of the L-shaped members and a corresponding one of the plate mounting brackets.

The second means comprises a support member and a leaf spring having a first end affixed to the support member and a spaced opposite end extending from the support member whereby the spring is abutted by a side of the instrument platform and pressed against the support member when the instrument platform rotates in the determined direction and abuts and obstructs the instrument platform when the instrument platform rotates in the opposite direction.

Each of the plate mounting brackets comprises an angle member having two plates extending substantially perpendicularly to each other in substantially perpendicular planes, one of the plates being affixed to the instrument platform and a corresponding one of the instrument support plates being pivotally coupled to the second of the plates.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENT

Figure 2:
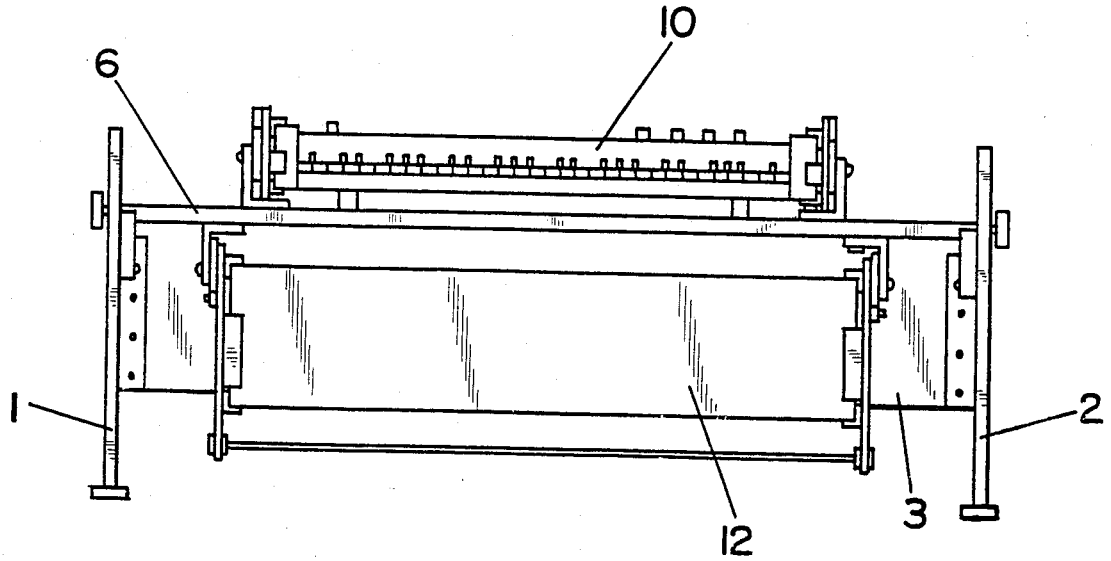
FIG. 2 is a front view of the embodiment of FIG. 1, showing a first keyboard instrument in playing position and a second keyboard instrument in stored position.
Figure 3:
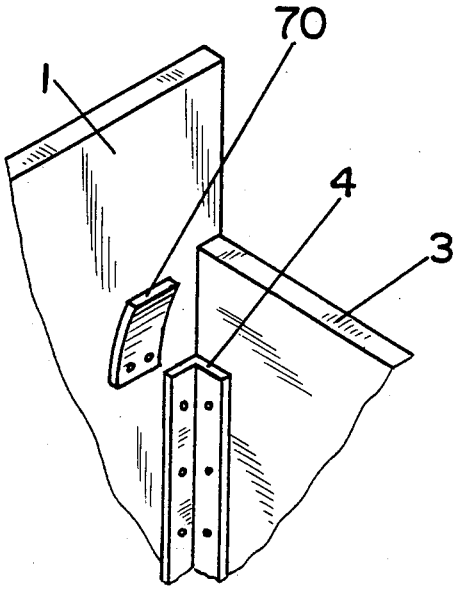
FIG. 3 is a perspective view, on an enlarged scale, of an embodiment of a stand joining bracket and an embodiment of a leaf spring support of the device of the invention.
Figure 4:
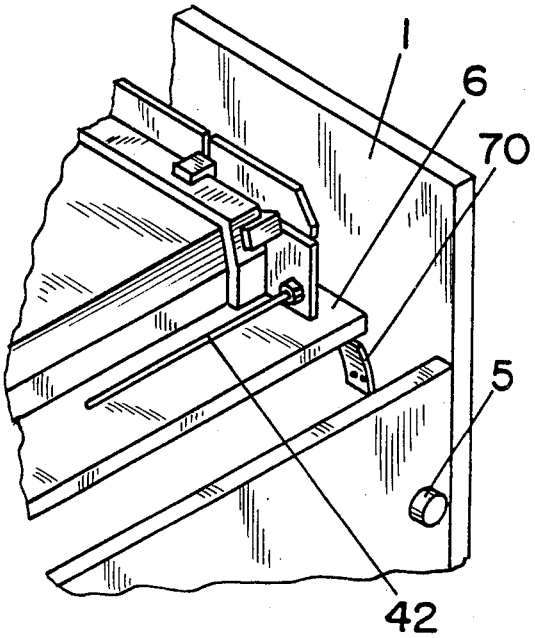
FIG. 4 is a perspective view, on an enlarged scale, of the leaf spring support in operation and an embodiment of the lateral retention bar of the device of the invention.

The musical keyboard instrument support device of the invention comprises a stand having a left side support 1, a right side support 2 and a rear panel 3 (FIGS. 1 and 2), joined together at the corners bounded by said rear panel and each of the two side supports by joining brackets, of which one joining bracket 4 is shown in FIG. 3, and various panel mounting bolts, of which one panel mounting bolt 5 is shown in FIG. 4. The pane mounting bolts 5 affix the panel 3 and side supports 1 and 2 to the joining brackets 4. The side supports 1 and 2 and rear panel 3 are joined to each other, via the joining brackets 4, to form a square U-shaped stand.

Figure 5:
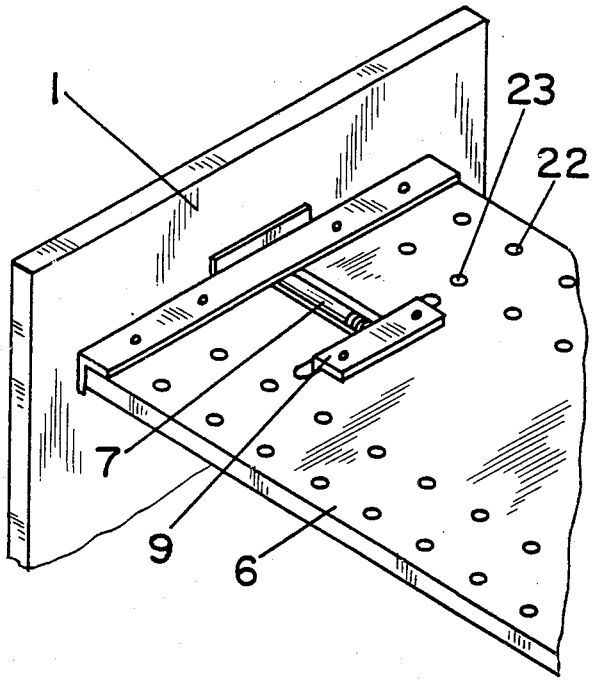
FIG. 5 is a perspective view, on an enlarged scale, of an embodiment of an instrument platform support bolt and an embodiment of a support bolt bracket of the device of the invention.
Figure 9:
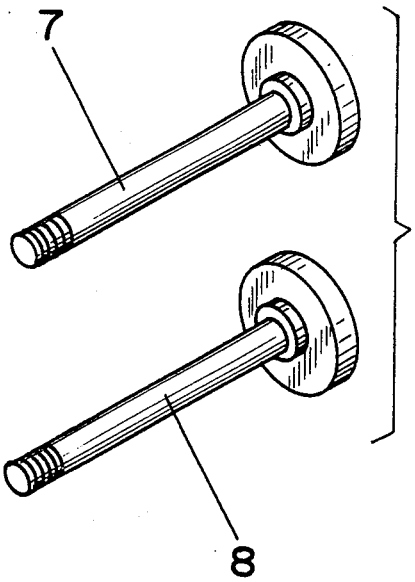
FIG. 9 is a perspective view, on an enlarged scale, of an embodiment of both instrument support bolts of the device of the invention.

An instrument platform 6 (FIGS. 1, 2 and 4 to 7) is pivotally mounted between the two side supports 1 and 2 via a pair of instrument platform support bolts 7 and 8 (FIGS. 5 and 9) which pass through suitably located holes in each of the two side supports 1 and 2 and ultimately terminate in two support bolt brackets, respectively, permanently affixed to each end of the instrument platform, on the undersurface thereof (FIG. 5). One of the support bolt brackets 9 is shown in FIG. 5. Thus, the instrument platform 6 and a musical keyboard instrument 10 mounted thereon (FIGS. 1 and 7) are freely pivotable about the longitudinal axis (FIG. 6).

Two portable electronic keyboard instruments 10 and 12 are mounted on both sides of the instrument platform 6 by two pairs of instrument-mounting subassemblies. One of the keyboard instruments 10 and 12 is maintained in playing position by the device of the invention while the other is maintained in storage position. Thus, as shown in FIG. 2, the keyboard instrument 10 is in playing position and the keyboard instrument 12 is in storage position. Since the instrument-mounting subassemblies are identical, only one is described herein, as shown in FIGS. 6, 7 and 8.

Figure 6:
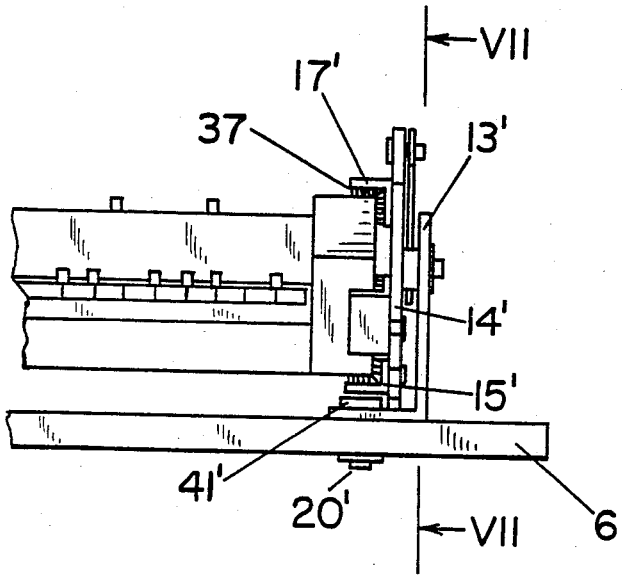
FIG. 6 is a front view, on an enlarged scale, of part of the embodiment of FIG. 1.
Figure 7:
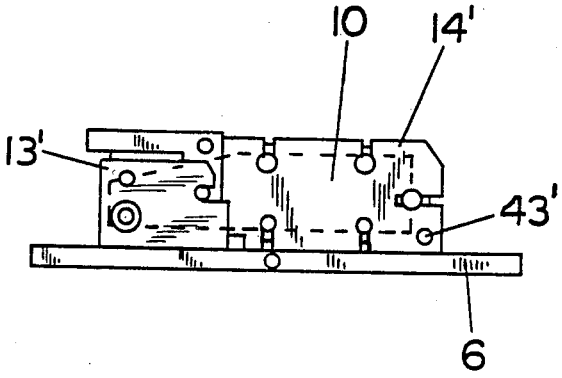
FIG. 7 is a side view, taken along the lines VII—VII, of FIG. 6.
Figure 8:
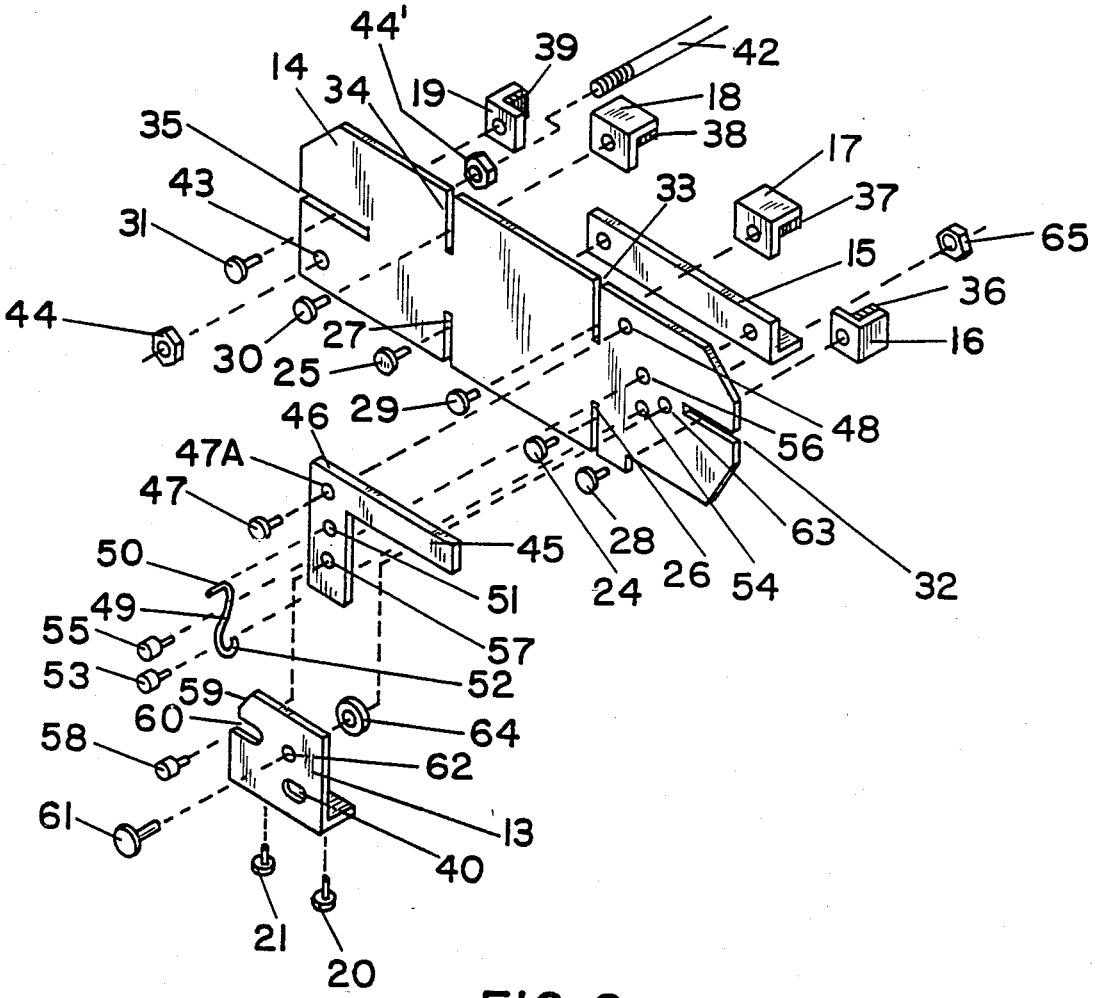
FIG. 8 is an exploded view, on an enlarged scale, of the embodiment of FIG. 1.
Figure 10:
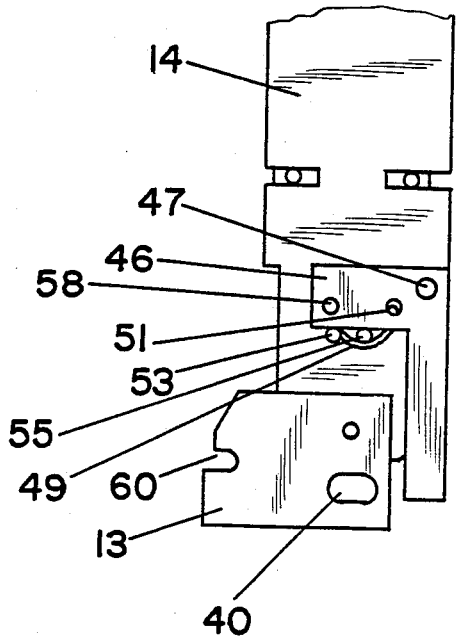
FIG. 10 is a side view, on an enlarged scale, of an embodiment of a locking lever and an embodiment of a plate mounting bracket of the device of the invention in a first position of operation.

As shown in FIGS. 6, 7 and 8, each instrument-mounting subassembly comprises a plate mounting bracket 13, an instrument support plate 14 (FIGS. 6 to 8 and 10 to 13), an instrument bottom retention clamp 15 (FIGS. 6 and 8) and a plurality of instrument retention clamps 16, 17, 18, 19 (FIG. 8). A musical keyboard instrument 10 is mounted on the instrument platform 6 in an approximately left-right centered position. Then, one of the instrument-mounting subassemblies designed to mount the left side of the instrument 10 is placed against the left side of said instrument. Two bolts 20 and 21 (FIG. 8) are then passed up through a given pair of mounting bracket holes 22 and 23, respectively (FIG. 5), selected for their close proximity to the mounting holes of the plate mounting bracket 13. The bolts 20 and 21 are subsequently tightened, thereby permanently affixing the plate mounting bracket 13 to the instrument platform 6.

The instrument bottom retention clamp 15 is mounted on the instrument support plate 14 via retention clamp mounting screws 24 and 25 (FIG. 8) passing through slots 26 and 27, respectively, of said support plate (FIG. 8). The clamp 15 is then moved upward until the lip of the clamp comes into contact with the bottom edge of the keyboard instrument 10. Once in contact, the mounting screws 24 and 25 are tightened so that the bottom retention clamp 15 is permanently affixed to the support plate 14.

The four instrument retention clamps 16 to 19 and their associated mounting screws 28 to 31, respectively (FIG. 8), are singularly engaged via corresponding retention clamp mounting slots 32 to 35, respectively (FIG. 8), of the instrument support plate 14. Each retention clamp 28 to 31 is moved down or inward, in its mounting slot 32 to 35, respectively, and is subsequently manipulated to cause a felt-covered internal surface of each clamp to abut the periphery of the side surface of the keyboard instrument 10. The instrument retention clamps 16 to 19 have felt 36 to 39, respectively, affixed to their inside surfaces, as shown in FIG. 8. The two clamps 16 and 19 are separately installed at the front and rear of the instrument 10 and the two remaining clamps 17 and 18 are installed at two locations along the top periphery of the side of said instrument. Once the retention clamp mounting screws 28 to 31 are tightened in place, the instrument 10 is essentially permanently affixed to the instrument support plate 14 for rotation in all degrees of freedom, as defined by the flat surface of said plate.

An access hole 40 is formed through the plate mounting bracket 13, as shown in FIGS. 10 to 13. The access holes through the plate mounting brackets provide access to the mounting screw associated with the front retaining clamp.

Figure 1:
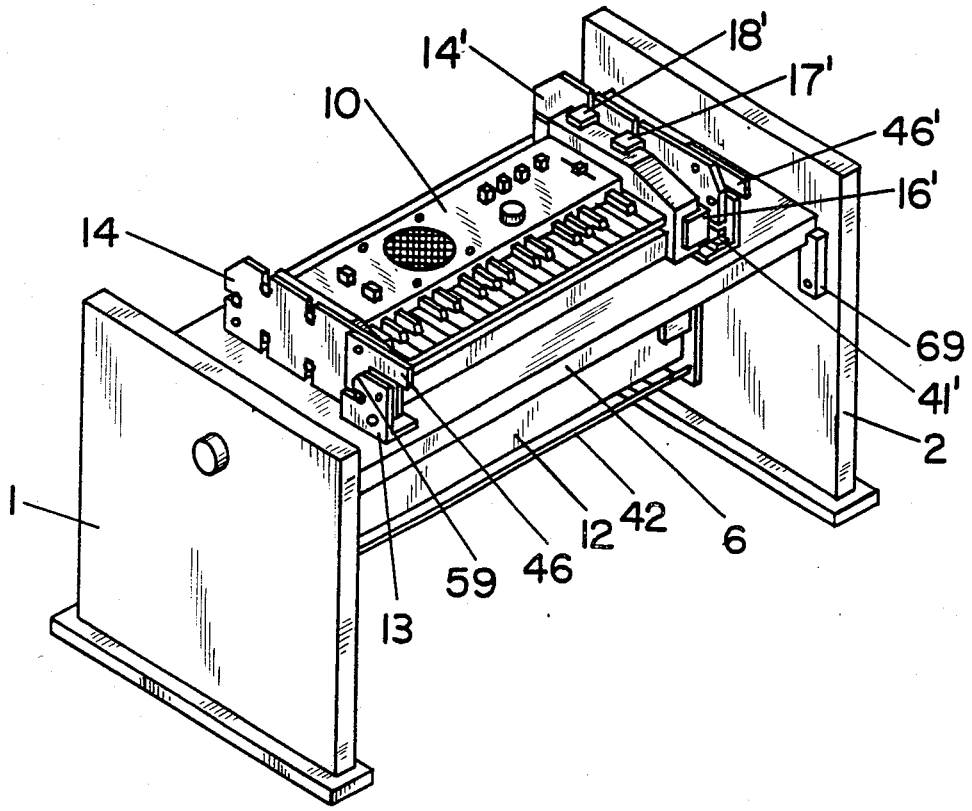
FIG. 1 is a perspective view of an embodiment of the musical keyboard instrument support device of the invention.

Upon completion of the mounting of the left-side instrument mounting subassembly to the instrument platform 6 and the installation of the various retention clamps 15 to 19, the entire aforedescribed process is repeated for the mounting of the right-side instrument mounting subassembly. In this manner, both the left and right sides of the musical keyboard instrument 10 are secured to the instrument platform 6. The instrument mounting subassembly is placed against the right side of the keyboard instrument 10 while the location of two slots in the mounting foot of the plate mounting bracket 13' (FIGS. 6 and 7) is observed in relation to a given pair of mounting bracket holes 22' and 23' (not shown in the FIGS.) of the instrument platform 6. Once the pair of mounting holes closest to the mounting slots has been determined, two screws 20' (FIG. 6) and 21' (not shown in the FIGS.) are passed through said holes and are threaded into holes in a mounting bar 41 (FIG. 1). After the plate mounting bracket 13' has been finally positioned, the screws 20' and 21' are tightened to permanently affix said bracket to the instrument platform 6.

After all the retention clamps 15 to 19 have been positioned and securely mounted, the mounting of the first musical keyboard instrument 10 is completed by the installation of a lateral retention bar 42 (FIG. 4). Each end of the lateral retention bar 42 is passed through a corresponding hole through the lower rear area of each of the instrument support plates 14 and 14', of which the hole 43 through the instrument support plate 14 is shown in FIG. 8 and the hole 43' through the instrument support plate 14' is shown in FIG. 7. Two nuts 44 and 44' (FIG.8) are threaded on the corresponding ends of the lateral retention bar 42 and are adjusted and subsequently tightened against each other at the surface of each instrument support plate 14 and 14', causing the rear portions of said instrument support plates to be laterally locked to each other via said bar. The axial stiffness of the lateral retention bar 42 prevents the rear portions of the instrument support plates 14 and 14' from spontaneously spreading apart thereby avoiding possible disengagement and dislodging of the musical keyboard instrument 10 from the instrument retention clamps 15 to 19, and ultimately said support plates, when said instrument is hanging vertically in the storage position.

After the first musical keyboard instrument 10 has been mounted, the instrument platform 6 is flipped forward to cause said instrument just mounted to be positioned beneath said platform. The flipping motion is continued until the first keyboard instrument 10 is positioned in an approximately vertical position, facing the rear panel 3 (FIGS. 1 and 2). At this time, the operator reaches to the top edge of the instrument platform 6 and grasps locking lever handles 45 and 45' of locking levers 46 and 46', respectively (FIG. 1). Since the left side locking lever 46 and the right side locking lever 46' are identical, only the locking lever 46 is shown in FIGS. 8 and 10 to 15.

Figure 12:
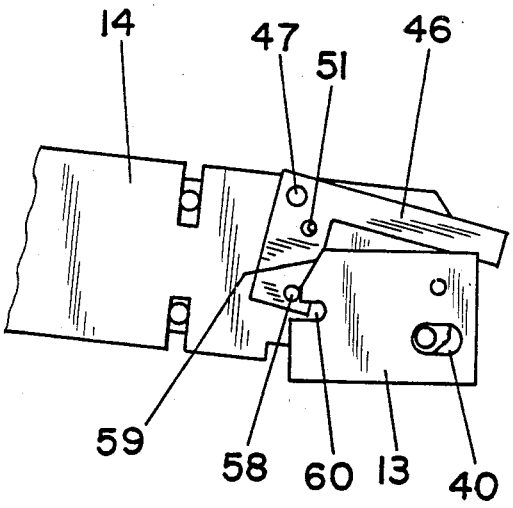
FIG. 12 is a side view, on an enlarged scale, of the embodiments of FIG. 10 in a third position of operation.
Figure 13:
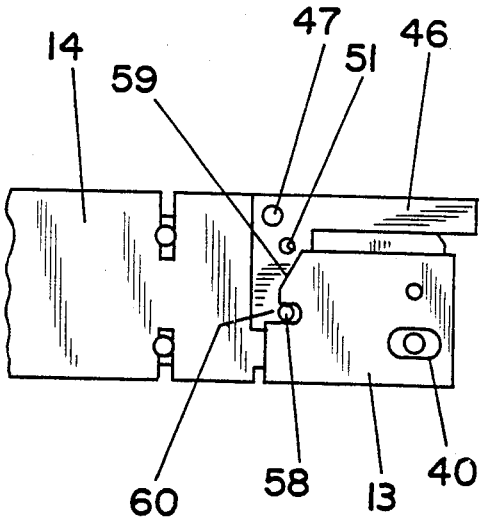
FIG. 13 is a side view, on an enlarged scale, of the embodiments of FIG. 10 in a fourth position of operation.
Figure 14:
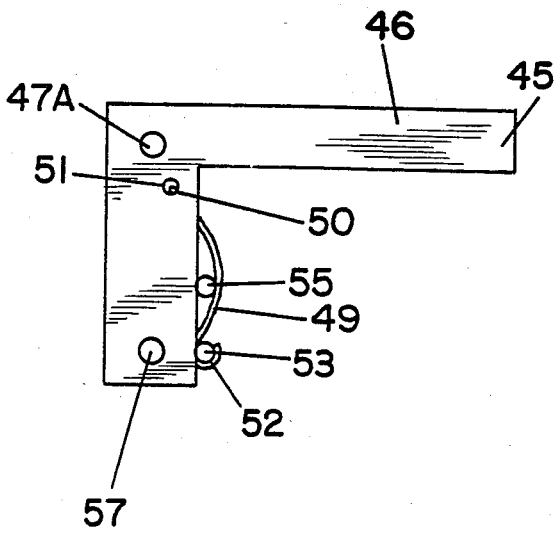
FIG. 14 is a side view, on an enlarged scale, of an embodiment of a locking lever of the invention and its wire spring, in lock position.
Figure 15:
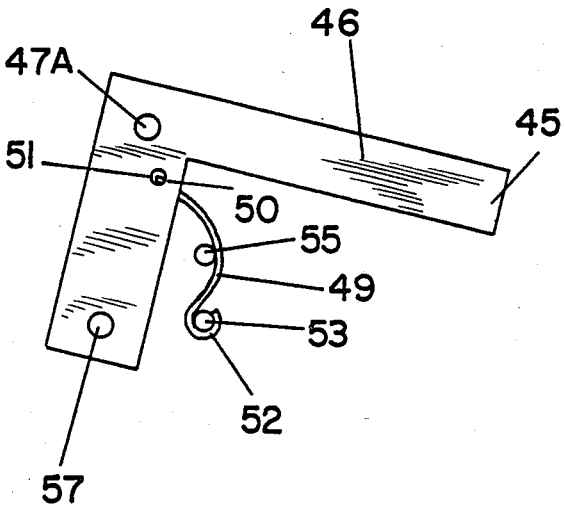
FIG. 15 is a side view, on an enlarged scale, of the embodiment of FIG. 14 in its unlocked position.

The locking lever 46 is pivotally mounted on the instrument support plate 14 via a locking lever pivot bolt 47 (FIGS. 8 and 10 to 12) which is passed through a pivot hole 47A through said locking lever (FIGS. 8, 14 and 15) and threadedly coupled to the instrument support plate 14 via a corresponding hole 48 (FIG. 8). The locking lever 46 is spring-biased by a wire spring 49 (FIGS. 8, 10, 11, 14 and 15) having an end 50 (FIGS. 8, 14 and 15) bent at right angles thereto and extending into a spring retention hole 51 formed through said locking lever (FIGS. 8 and 10 to 15). The wire spring 49 has a spaced opposite end 52, bent in substantially U-shape, as shown in FIGS. 8, 14 and 15, and secured to the instrument support plate 14 via a first locking lever stop screw 53 (FIGS. 8, 10, 14 and 15) and a hole 54 formed through said support plate (FIG. 8). The approximate middle portion of the wire spring 49 is tensioned against the second locking lever stop screw 55 (FIGS. 8, 10, 11, 14 and 15) which is affixed to the instrument support plate 14 via a hole 56 formed through said support plate (FIG. 8).

After grasping the two protruding locking lever handles 45 and 45' with both hands, the operator pulls said handles toward himself thereby unlocking the musical keyboard instrument 10 from the instrument support plate 14 and permitting said keyboard instrument to pivot about the plate mounting bracket 13, when the instrument platform 6 is flipped toward the operator through an arc of approximately 90° to its normal flat horizontal position. At such time, the first musical keyboard instrument 10 hangs vertically beneath the instrument platform 6, adjacent the rear panel 3 and the surface of said platform is clear and ready to receive the second musical keyboard instrument 12, which is then mounted on said platform in the same manner as said first keyboard instrument.

FIG. 14 shows the locking lever 46 in its rest, or locked, position and FIG. 15 shows said lever in its actuated, or unlocked, position. As shown in FIGS. 8, 14 and 15, the locking lever 46 has a lock hole 57 formed therethrough. A locking stud 58 (FIGS. 8 and 10 to 13) is threadedly secured to the locking lever 46 via the lock hole 57. The plate mounting bracket 13 has a cam surface 59 (FIGS. 1, 8 and 10 to 13) and a locking slot 60 formed therein in proximity with said cam surface, as shown in FIGS. 8 and 10 to 13, adapted to accommodate the locking stud 58. The instrument support plate 14 is pivotally affixed to the instrument platform 6 via the plate mounting bracket 13. More particularly, the instrument support plate 14 is pivotally affixed to the plate mounting bracket 13 via a plate pivot screw 61 (FIGS. 8 and 16 to 23) which passes through a pivot hole 62 (FIG. 8) formed through said plate mounting bracket and a pivot hole 63 (FIG. 8) formed through said instrument support plate.

The instrument support plate 14' is pivotally affixed to the plate mounting bracket 13' (not shown in the FIGS.) via a plate pivot screw 61' (not shown in the FIGS.) in the same manner as the instrument support plate 14. A washer 64 (FIG. 8) is mounted on the plate pivot screw 61 between the plate mounting bracket 13 and the instrument support plate 14 and said screw is secured by a nut 65 (FIG. 8).

The second musical keyboard instrument 12 is mounted on the opposite surface of the instrument platform 6 from that on which the first musical keyboard instrument is mounted. The second musical keyboard instrument 12 is affixed to a pair of instrument support plates, only one of which, 66, is shown in FIGS. 16 to 23. The instrument support plates 66 and 66' (not shown in the FIGS.) are pivotally affixed to the instrument platform 6 via plate mounting brackets 67 and 67', respectively, of which only the bracket 67 is shown in FIGS. 16 to 23. More particularly, the instrument support plate 66 is pivotally affixed to the plate mounting bracket 67 via a plate pivot screw 68 (FIGS. 16 to 23) in the aforedescribed manner. The instrument support plate 66' (not shown in the FIGS.) is pivotally affixed to the plate mounting bracket 67' (not shown in the FIGS.) via a plate pivot screw 68' (not shown in the FIGS.) in the same manner as the instrument support plate 66.

FIGS. 16 to 23 illustrate the sequence of events required to bring into playing position, the second musical keyboard instrument 12, which was positioned in the storage position while the first musical keyboard instrument 10 was in playing position. The views shown are taken from the right side of the device, with the right side support 2 removed for clarity of illustration. The angles referred to are only approximate positional indicators and are not critical to the operation of the device.

Figure 16:
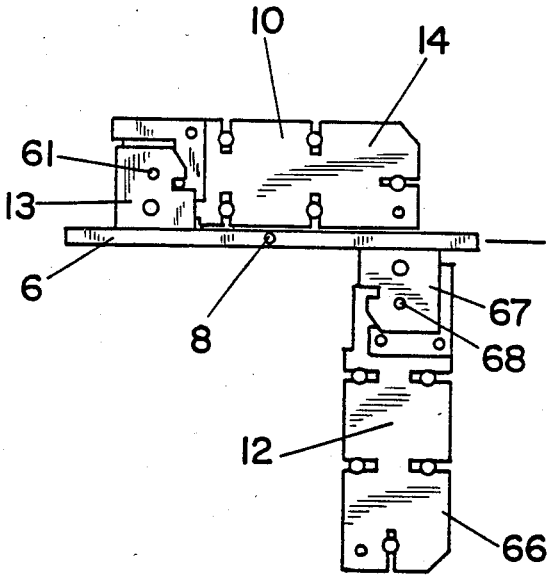
FIGS. 16 to 23 are schematic diagrams, on an enlarged scale, of plate mounting brackets and instrument support plates of first and second musical keyboard instruments, illustrating the positioning of said instruments relative to each other.

In FIG. 16, the instrument platform 6 is positioned in the normal horizontal playing position, with the first keyboard instrument 10 in the playing position and the second keyboard instrument 12 in the storage position. An anti-rotation latch 69 (FIG. 1) is engaged at the front of the instrument platform 6 to prevent counterclockwise rotation. The rear edge of the instrument platform 6 rests on the stop surface of a leaf spring support 70 (FIGS. 3 and 4), thus inhibiting clockwise rotation due to the pull of gravity manifested by the hanging off-centered orientation of the second keyboard instrument 12.

Figure 17:
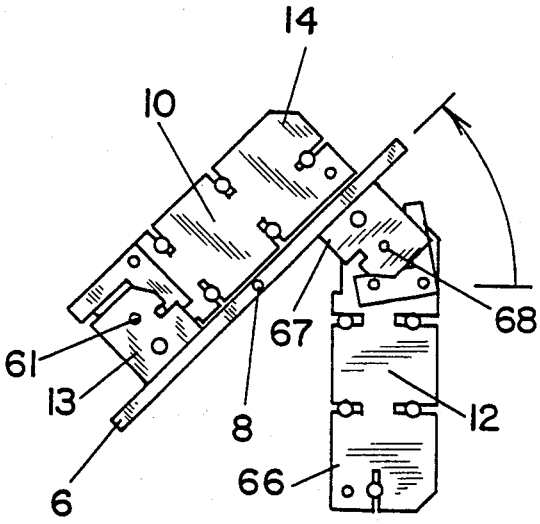

In FIG. 17, the instrument platform 6 is rotated about the instrument platform support bolt 8. This is accomplished by the operator grasping the rear edge of the instrument platform 6 with one hand and lifting up, while simultaneously pushing down on the front edge of said platform with the remaining hand in a circular arc. The first keyboard instrument 10 remains in contact with the instrument platform 6 due to the pull of gravity. The second keyboard instrument 12, however, begins to rotate, relative to the instrument platform 6, about the axis defined by the instrument support plate pivot screw 68, such rotation being caused by the downward pull of gravity.

Figure 18:
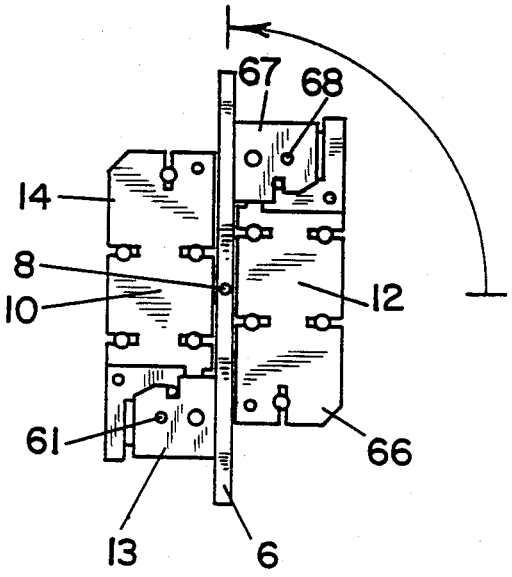

FIG. 18 shows the instrument platform 6 positioned approximately 90° from the zero reference. Due to its pivotal mounting and the normal pull of gravity, the second keyboard instrument 12 then rests against the instrument platform and the first keyboard instrument 10 balances on top of its mounting pivot and is prevented from spontaneously flipping forward by the continued engagement of the locking stud 58 of the locking lever 46 in the locking slot 60 of the plate mounting bracket 13, as shown in FIG. 13.

Figure 19:
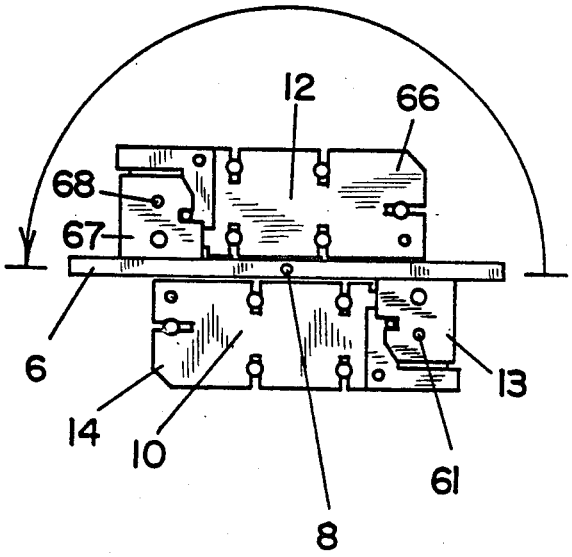

In FIG. 19, the platform is rotated approximately 180°. The second keyboard instrument 12 continues to abut the instrument platform 6 due to gravity and the first keyboard instrument 10 continues to be held against the opposite surface of said instrument platform by the locking stud 58 remaining in the locking slot 60 of the plate mounting bracket 13, as shown in FIG. 13. In the sequence of rotation of the instrument platform 6 from the 90° to the 180° position, the right-rear and left-rear corners of said intrument platform come to bear against the flat surfaces of the leaf spring supports 70, causing said supports to be pushed against their respective side supports 1 and 2, as said instrument platform passes through the 180° position. After the instrument platform passes through the 180° position, the leaf spring supports 70 spring away from the surfaces of the side supports 1 and 2 to their normal relaxed positions. Any attempt to rotate the instrument platform 6 from the position shown in FIG. 19 to that of FIG. 18 would be countered by the stop surface of said leaf spring supports. The leaf spring supports 70 therefore function as a one-way latch, preventing the rotation of the instrument platform 6 in the clockwise direction, once said instrument platform rotates beyond the 180°, or 0°, positions.

Figure 20:
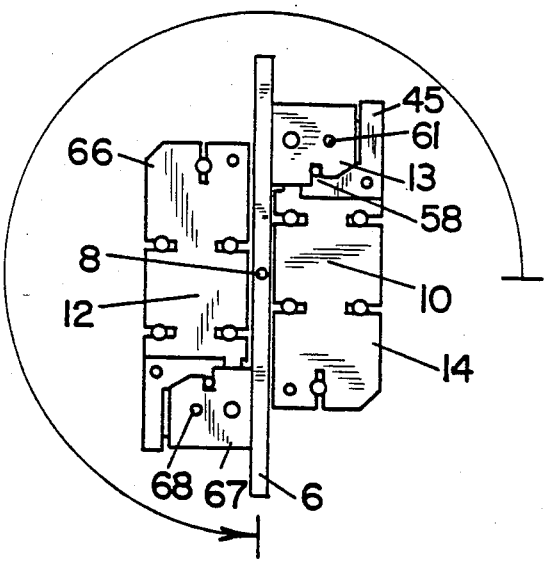

FIG. 20 shows the instrument platform 6 positioned approximately 270°. When the instrument platform 6 is in the position shown in FIG. 20, the operator gently brings his leg against the exposed surface of the second musical keyboard instrument 12 to prevent possible spontaneous clockwise rotation.

Figure 11:
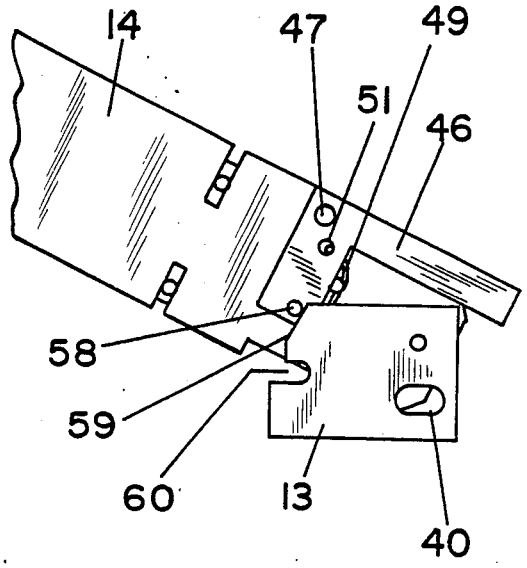
FIG. 11 is a side view, on an enlarged scale, of the embodiments of FIG. 10 in a second position of operation.
Figure 21:
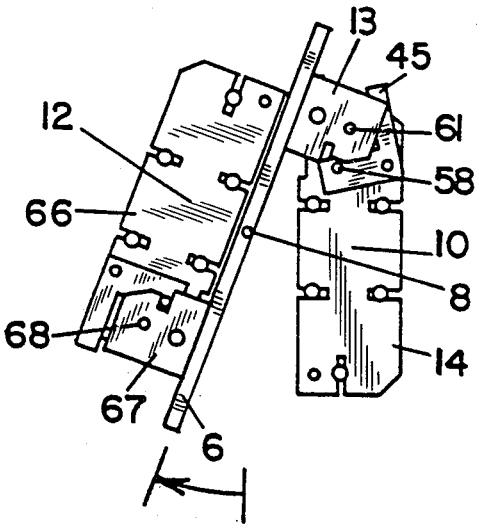

While the operator is positioning the instrument platform 6 as depicted in FIG. 20, he permits the top edge of said instrument platform to tilt slightly forward, as shown in FIG. 21, while reaching behind the same top edge with both hands to grasp and pull both exposed locking lever handles 45 and 45' toward himself. The pulling of the locking lever handles 45 and 45' toward the operator causes the locking lever to rotate about the locking lever pivot bolt 47, releasing the locking studs 58 from their respective locking slots 60 (FIG. 13). In this position, the locking stud 58 rides against the plate mounting bracket cam surface 59 due to the constant rotary force applied to the locking lever 46 via the wire spring 49, as shown in FIGS. 11 and 12. Once the locking studs 58 are released from their respective locking slots 60, the operator places one hand on the top of the instrument platform 6 and places his other hand on the bottom of said instrument platform. The operator then rotates the instrument platform 6 in a clockwise direction, as shown in FIG. 22.

Figure 22:
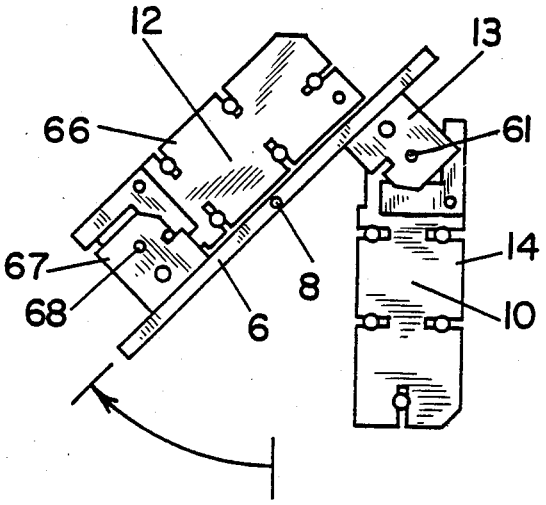

FIG. 22 shows the first keyboard instrument 10 hanging vertically, due to the pull of gravity, because the locking studs 58 have been released from the locking slots 60. The first keyboard instrument 10 is then suspended by, and allowed to rotate about the plate pivot screw 61, and the second keyboard instrument 12 continues to abut the instrument platform 6 due to gravity.

Figure 23:
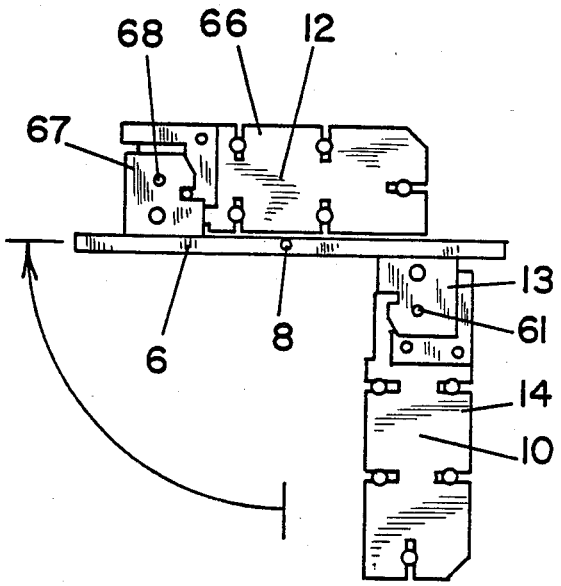

FIG. 23 shows the final step in the sequence of deploying the second keyboard instrument 12 in the normal playing position. In FIG. 23, the rear edge of the instrument platform 6 rests on the stop surface of the leaf spring support 70. The operator then engages the notch of the anti-rotation latch 69 with the front edge of the instrument platform 6, as shown in FIG. 1, to prevent clockwise and counterclockwise rotation of said instrument platform.

While the invention has been described by means of a specific example and in a specific embodiment, I do not wish to be limited thereto, for obvious modifications will occur to those skilled in the art without departing from the spirit and scope of the invention.

I claim:

1. A support device for supporting first and second units, each having a front edge and a pair of spaced opposite substantially parallel sides at the opposite ends of said front edge substantially perpendicular to said front edge, said device comprising an instrument platform having first and second spaced opposite substantially parallel substantially planar surfaces;

mounting means rotatably supporting said instrument platform for rotation about an axis of rotation;

first joining means for pivotally mounting said first unit on said first surface of said instrument platform for rotation about an axis spaced from and substantially parallel to said axis of rotation;

a first pair of locking means for locking said first unit in substantially abutting relation to said first surface in locked position and for releasing said first unit to hang freely substantially vertically with said first surface in unlocked position whereby said first unit is in playing position when said instrument platform is substantially horizontal with said first surface up and in stored position, hanging from said first surface, when said instrument platform is substantially horizontal with said first surface down;

second joining means for pivotally mounting said second unit on said second surface of said instrument platform for rotation about an axis spaced from and substantially parallel to said axis of rotation; and a second pair of locking means for locking said second unit in substantially abutting relation to said second surface in locked position and for releasing said second unit to hang freely substantially vertically with said second surface in unlocked position whereby said second unit is in playing position when said instrument platform is substantially horizontal with said second surface up and in stored position, hanging from said second surface, when said instrument platform is substantially horizontal with said second surface down.

2. A support device as claimed in claim 1, wherein each of said first and second units is an instrument.

3. A support device as claimed in claim 1, wherein each of said first and second units is a keyboard instrument having a keyboard extending along the front edge thereof.

4. A support device as claimed in claim 1, wherein each of said first and second units is a musical keyboard instrument having a keyboard extending along the front edge thereof.

5. A support device as claimed in claim 1, wherein said first joining means comprises a first pair of plate mounting brackets affixed to said first surface of said instrument platform in spaced substantially parallel relation, substantially perpendicular to said first and second surfaces and to said axis of rotation, and said second joining means comprises a second pair of plate mounting brackets affixed to said second surface of said instrument platform in spaced substantially parallel relation, substantially perpendicular to said first and second surfaces and to said axis of rotation.

6. A support device as claimed in claim 5, wherein said first joining means further comprises a first pair of support plates each clamped to a corresponding side of said first unit, each of said first pair of support plates being pivotally coupled to a corresponding one of said first pair of plate mounting brackets, and said second joining means further comprises a second pair of support plates each clamped to a corresponding side of said second unit, each of said second pair of support plates being pivotally coupled to a corresponding one of said second pair of plate mounting brackets.

7. A support device as claimed in claim 6, wherein said first joining means further comprises a first pair of locking means each pivotally mounted on a corresponding one of said first pair of support plates and interposed between and cooperating with said corresponding one of said support plates and the corresponding one of said first pair of plate mounting brackets for locking said first unit in substantially abutting relation to said first surface in locked position and for releasing said first unit to hang freely from said first pair of plate mounting brackets substantially vertically with said first surface in unlocked position, and said second joining means further comprises a second pair of locking means each pivotally mounted on a corresponding one of said second pair of support plates and interposed between and cooperating with said corresponding one of said support plates and the corresponding one of said second pair of plate mounting brackets for locking said second unit in substantially abutting relation to said second surface in locked position and for releasing said second unit to hang freely from said second pair of plate mounting brackets substantially vertically with said second surface in unlocked position.

8. A musical keyboard instrument support device for supporting first and second musical keyboard instruments each having a front edge, a keyboard extending along said front edge and a pair of spaced opposite substantially parallel sides at the opposite ends of said front edge substantially perpendicular to said front edge, said device comprising an instrument platform having first and second spaced opposite substantially parallel substantially planar surfaces;

mounting means rotatably supporting said instrument platform for rotation about an axis of rotation;

a first pair of plate mounting brackets affixed to the first surface of said instrument platform in spaced substantially parallel relation, substantially perpendicular to said first and second surfaces and to said axis of rotation;

a first pair of instrument support plates each clamped to a corresponding side of said first keyboard instrument, each of said first pair of instrument support plates being pivotally coupled to a corresponding one of said first pair of plate mounting brackets;

a first pair of locking means each pivotally mounted on a corresponding one of said first pair of instrument support plates and interposed between and cooperating with said corresponding one of said first pair of instrument support plates and the corresponding one of said first pair of plate mounting brackets for locking said first keyboard instrument in substantially abutting relation to said first surface in locked position and for releasing said first keyboard instrument to hang freely from said first pair of plate mounting brackets substantially vertically with said first surface in unlocked position whereby said first keyboard instrument is in playing position when said instrument platform is substantially horizontal with said first surface up and in stored position, hanging from said first pair of plate mounting brackets, when said instrument platform is substantially horizontal with said first surface down;

a second pair of plate mounting brackets affixed to the second surface of said instrument platform in spaced substantially parallel relation, substantially perpendicular to said first and second surfaces and to said axis of rotation;

a second pair of instrument support plates each clamped to a corresponding side of said second keyboard instrument, each of said second pair of instrument support plates being pivotally coupled to a corresponding one of said second pair of plate mounting brackets; and a second pair of locking means each pivotally mounted on a corresponding one of said second pair of instrument support plates and interposed between and cooperating with said corresponding one of said second pair of instrument support plates and the corresponding one of said second pair of plate mounting brackets for locking said second keyboard instrument in substantially abutting relation to said second surface in locked position and for releasing said second keyboard instrument to hang freely from said second pair of plate mounting brackets substantially vertically with said second surface in unlocked position whereby said second keyboard instrument is in playing position when said instrument platform is substantially horizontal with said second surface up and in stored position, hanging from said second pair of plate mounting brackets, when said instrument platform is substantially horizontal with said second surface down.

9. A support device as claimed in claim 8, further comprising a plurality of instrument retention clamps adjustably coupling each of said first and second pair of instrument support plates to said corresponding first and second keyboard instruments.

10. A support device as claimed in claim 8, further comprising first means for selectively maintaining said instrument platform in substantially horizontal position and preventing rotation thereof in a predetermined direction and second means for permitting said instrument platform to rotate in a determined direction and preventing said instrument platform from rotating in the opposite direction.

11. A support device as claimed in claim 10, wherein said second means comprises a support member and a leaf spring having a first end affixed to said support member and a spaced opposite end extending from said support member whereby said spring is abutted by a side of said instrument platform and pressed against said support member when said instrument platform rotates in said determined direction and abuts and obstructs said instrument platform when said instrument platform rotates in said opposite direction.

12. A support device as claimed in claim 8, wherein each of said first and second pair of locking means comprises a substantially L-shaped member having a corner, two arms extending from said corner substantially perpendicularly to each other and substantially coplanar, a locking stud affixed to one of said arms and means pivotally affixing each of said L-shaped members at its corner to a corresponding one of said instrument support plates, and wherein each of said first and second pair of plate mounting brackets has a locking slot formed therein and a cam surface formed thereon to facilitate locking operation of said locking stud of each of said L-shaped members and a corresponding one of said plate mounting brackets.

13. A support device as claimed in claim 12, wherein each of said plate mounting brackets comprises an angle member having two plates extending substantially perpendicularly to each other in substantially perpendicular planes, one of said plates being affixed to said instrument platform and a corresponding one of said instrument support plates being pivotally coupled to the second of said plates.

* * * * *